US008769874B1

(12) United States Patent
Lai

(10) Patent No.: US 8,769,874 B1
(45) Date of Patent: Jul. 8, 2014

(54) ADJUSTABLE SILL AND THRESHOLD

(75) Inventor: Ken Ming Lai, San Francisco, CA (US)

(73) Assignee: Ken Ming Lai, San Francisco, CA (US)

( * ) Notice: Subject to any disclaimer, the term of this patent is extended or adjusted under 35 U.S.C. 154(b) by 337 days.

(21) Appl. No.: 12/361,496

(22) Filed: Jan. 28, 2009

(51) Int. Cl.
*E06B 1/70* (2006.01)

(52) U.S. Cl.
USPC ..... 49/467; 49/468; 52/204.51; 411/373

(58) Field of Classification Search
USPC ..... 49/468, 467; 52/204.51; 411/372.5–374
See application file for complete search history.

(56) References Cited

U.S. PATENT DOCUMENTS

| | | | | | |
|---|---|---|---|---|---|
| 3,008,198 | A * | 11/1961 | Grunwald | 49/467 |
| 3,354,757 | A * | 11/1967 | Grimm et al. | 81/176.1 |
| 3,962,828 | A * | 6/1976 | McAllister | 49/468 |
| 3,967,412 | A * | 7/1976 | Governale | 49/468 |
| 4,352,258 | A * | 10/1982 | Bursk et al. | 49/468 |
| 4,711,760 | A * | 12/1987 | Blaushild | 376/399 |
| 5,010,690 | A * | 4/1991 | Geoffrey | 49/468 |
| 5,179,804 | A * | 1/1993 | Young | 49/471 |
| 5,230,181 | A * | 7/1993 | Geoffrey et al. | 49/469 |
| 5,395,196 | A * | 3/1995 | Notaro | 411/396 |
| 5,426,894 | A * | 6/1995 | Headrick | 49/468 |
| 5,517,788 | A * | 5/1996 | McGough et al. | 49/468 |
| 5,524,391 | A * | 6/1996 | Joffe et al. | 49/468 |
| 5,611,173 | A * | 3/1997 | Headrick et al. | 49/468 |
| 5,638,641 | A * | 6/1997 | Joffe et al. | 49/469 |
| 6,185,870 | B1 * | 2/2001 | Mettler | 49/468 |
| 6,345,477 | B1 * | 2/2002 | Kepler et al. | 52/204.1 |
| 6,484,446 | B2 * | 11/2002 | Young | 49/469 |
| 7,389,611 | B2 * | 6/2008 | Palenske CI | 49/468 |
| 7,713,012 | B2 * | 5/2010 | Coonjohn | 411/372.6 |
| 2002/0129557 | A1 * | 9/2002 | Young | 49/468 |
| 2002/0194787 | A1 * | 12/2002 | Bennett | 49/467 |
| 2003/0035701 | A1 * | 2/2003 | Hui | 411/372.5 |
| 2004/0200152 | A1 * | 10/2004 | Khanlarian | 49/468 |
| 2004/0200153 | A1 * | 10/2004 | Khanlarian | 49/468 |
| 2005/0210754 | A1 * | 9/2005 | Ferrell | 49/468 |
| 2006/0053695 | A1 * | 3/2006 | Palenske | 49/468 |
| 2006/0112644 | A1 * | 6/2006 | Pepper et al. | 49/468 |
| 2006/0133910 | A1 * | 6/2006 | Wilson | 411/372.6 |
| 2006/0174545 | A1 * | 8/2006 | Young | 49/468 |
| 2008/0229669 | A1 * | 9/2008 | Abdollahzadeh et al. | 49/468 |

* cited by examiner

*Primary Examiner* — Katherine Mitchell
*Assistant Examiner* — Marcus Menezes
(74) *Attorney, Agent, or Firm* — Ken Ming Lai; Albert K. Lai

(57) ABSTRACT

A sill assembly with an adjustable threshold has: a removable cap; a housing with two vertical supporting walls to receive the cap, with two recessed channels in opposite locations of the walls; two rubber gaskets inserted into the vertical supporting walls' recessed channels; a vinyl substrate for supporting the housing; cap-screws; and adjustment screws. The cap is fastened onto housing by cap-screws which are coupled tightly below with the adjustment screws. The cap's inner walls are supported by the adjustment screws' large diametric disc. When the cap is inserted onto the housing, the interior of the cap's outer walls is compressing two rubber gaskets to create a tight sealing. Being covered by the cap and the housing's vertical supporting walls, the rubber gaskets are less susceptible to weatherization and possible damages, and the sill assembly's aesthetic appearance is enhanced because the visible part of the sill assembly looks consistent.

6 Claims, 5 Drawing Sheets

A---A

A---A

A---A
1
2
3
4
5
6
7
8
9
21

A--A

A--A

A--A

ADJUSTABLE SILL AND THRESHOLD

BACKGROUND OF THE INVENTION

This invention presents a sill assembly with an adjustable threshold to be installed onto the floor of an entry-door. A sill assembly with a threshold, either fixed or adjustable, is usually used with door jambs together to frame an entry-door unit. An entry-door is also commonly equipped at the bottom with a weatherstrip, for instance, a door sweep. When an entry-door is closed, the sill's threshold is in the same plane with the door's weather-strip, is flushed with it, and pressed against it; therefore, the sill assembly with a threshold helps prevent exterior water, moisture, and air from entering a home.

Prior arts include a variety of sill assemblies which have been designed to be installed as thresholds for doorway. The sill assemblies of prior arts can be classified into two categories: fixed sills and adjustable sills. Both categories of sills feature some generally recognizable parts: a unitary housing which holds all inner parts, two or multiple supporting legs, and a raised and flat platform against which an entry-door's weather-strip, such as a door sweep, is pressed when a door is closed.

In the first category, fixed sills have an elongated unitary body with or without a removable threshold cap. They are usually made of solid woods, or extruded metals, for examples, aluminum or brass. Sills in this category are fixed because the threshold sections are uniformly fixed and connected to the base, and cannot be adjusted by any means. Because sills are fixed, they have consistent height and shape from one end to the other end.

In the second category, adjustable sills also have an elongated unitary body, but usually with an adjustable threshold cap. Examples of adjustable sills include prior arts U.S. Pat. Nos. 5,426,894 and 5,517,788 and 5,638,641 and 6,345,477. The adjustable threshold cap and its housing can be made of extruded aluminum or routed hardwood. An adjustable sill is usually adjusted manually by hand to achieve a desired uniform height of the cap, so that the cap can be properly pressed against a weatherstrip which is installed at the entry-door's bottom. The said cap may have multiple screw-holes, punched and countersunk with equal spacing along the cap's longitudinal axis, so that adjustment screws can be fastened into the housing. An installer can lower the height by turning the adjustment screws clockwise, one-by-one in sequence. Conversely, an installer can raise the height by turning the adjustment screws counter-clockwise, one-by-one in sequence. In general, the adjustable sills of prior arts have adjustment screws which are visible and accessible from the threshold cap's top, as presented by U.S. Pat. Nos. 5,179,804 and 5,517,788 and 5,524,391. In the example of U.S. Pat. No. 6,345,477, the threshold cap's screw-holes are covered by plastic plugs.

In adjustable sills of prior arts, some lack water-proof seals, but others have exposed water-proof seals. Examples of adjustable sills that lack water-proof seals include U.S. Pat. Nos. 4,352,258 and 6,345,477. In these two prior-art examples, the absence of a water-proof seal may allow water, moisture, and air to penetrate through the sill into a home. Over time, the inner adjustment parts may deteriorate due to external weatherization.

Examples of adjustable sills that have water-proof seals are: U.S. Pat. Nos. 5,179,804 and 5,230,181 and 5,426,894 and 5,517,788 and 5,524,391 and 5,638,641 and 7,472,516. These prior inventions' water-proof seals may be made be of flexible vinyl, plastic, or foam weather-strip, all for preventing water, moisture, and air from passing through the sill into a home. Nonetheless, these prior inventions' water-proof seals are exposed and visible. Such exposed, visible seals can deteriorate over time due to weatherization and normal wear-and-tear. Finally, these exposed, visible seals reduce the aesthetic value of a uniform look and shape in the sill assemblies.

This invention presents a new sill assembly with an adjustable threshold, which is to be installed onto the floor of a doorway. This sill, being used together with a weather-strip, such as a door shoe, or vinyl sealing strip, is to block water, moisture, and air from entering a home.

SUMMARY OF THE INVENTION

This invention presents a new sill assembly with an adjustable threshold cap that rests on top of a housing. The housing is supported by one front foot, and by a vinyl substrate underneath. The adjustable threshold cap has been punched, in several locations with equal distance apart, to have screw-holes with countersinks. The cap is fastened to the adjustment screws by Phillips flat-headed cap-screws. Each cap-screw' lower portion has a center-hole. Each adjustment screw's head has vertical straight threads. The adjustment screw's head is locked tightly into the center-hole of the cap-screw, so that there is no disengagement from the cap-screw when the cap-screw is turned at the top manually with a screw-driver.

This invention also features adjustment screws each with a large diametric disc in the middle, to support the cap's two inner walls, so that any weight being exerted on the cap, is transferred through the adjustment screws to the housing and the vinyl substrate below. The adjustment screws are made with male threads. Both the housing and the vinyl substrate are tapped in the same locations on the same plane, with female screw-threads. The adjustment screws' male threads are mated with and engaged with the female threads of the housing and vinyl substrate, so that the adjustment screws connect and fasten the cap to the housing underneath, and simultaneously connect and fasten the housing to the substrate below.

Furthermore, this invention provides a vinyl substrate, which together with the housing's front foot, supports the overall sill assembly to a consistent height. The substrate's front side has an indented bottom. The substrate's indented front is slid into the housing's front interior and is flushed with the housing's front foot. The substrate's other side has a vertical back-wall. The backwall's interior side presses one side of the cap to push the latter into the correct position. Made from the same extruded vinyl, the said substrate's back-wall serves as an insulation to prevent hot or cold air from passing through the sill into a home.

As mentioned above, prior inventions have water-proof seals that are exposed, rather than hidden or covered. Prior inventions' exposed water-proof seals can easily deteriorate due to weatherization or unintentional damages or normal wear-and-tear; therefore, they may lose their air-tight, water-proof functions over time. Furthermore, prior inventions' exposed seals lack the aesthetic look in a uniform housing.

This invention provides a novel means of preventing water, moisture, and air from penetrating the sill into a home. The said novel means comprises of two rubber gaskets which are inserted into two recessed channels on the housing's vertical supporting walls. Both rubber gaskets have two enlarged sides and one narrow neck. Rubber gaskets are positioned in opposite directions, with one enlarged side inserted into a recessed channel. The other side of the each gasket is to face the cap. When the cap is inserted into the housing, the interior of the cap's outer walls, is facing a rubber gasket's enlarged side and is compressing the said rubber gasket to create a tight sealing. Because the rubber gaskets are covered by the cap above, the rubber gaskets are invisible, and are protected from weatherization and possible damages. This invisibility of the rubber gaskets in this invention enhances the sill assembly's aesthetic appearance, in contrast to the exposed gaskets in prior inventions. This invention specifically solves prior inventions' problems, by using the adjustable threshold cap to cover the said rubber gaskets, and by using the recessed channels in the housing's vertical supporting walls to fit and secure the rubber gaskets.

DETAILED DESCRIPTION OF THE INVENTION

Figure 2:
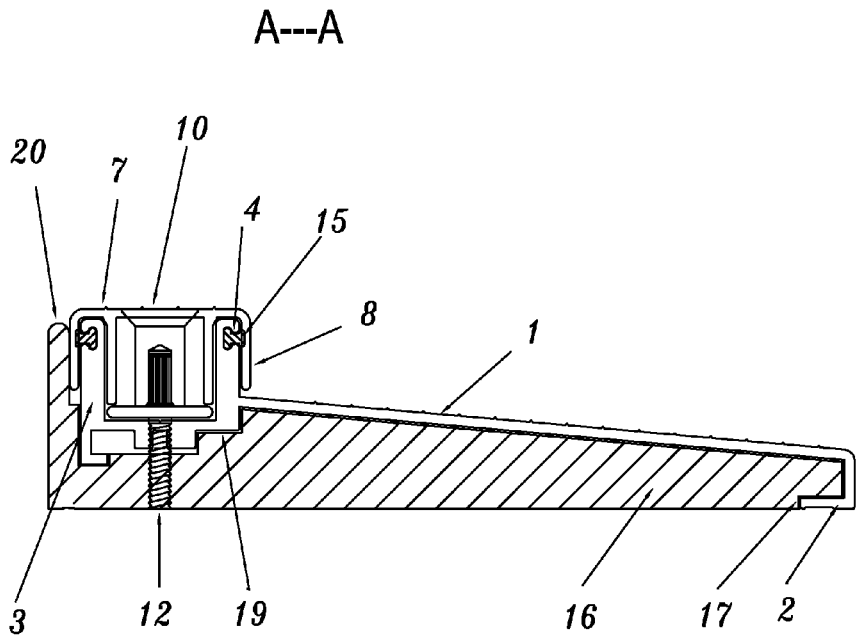
FIG. 2 is a cross-sectional side elevation view of the completely-assembled sill, showing all the components, taken at the cross-section line A-A of FIG. 1.
Figure 3:
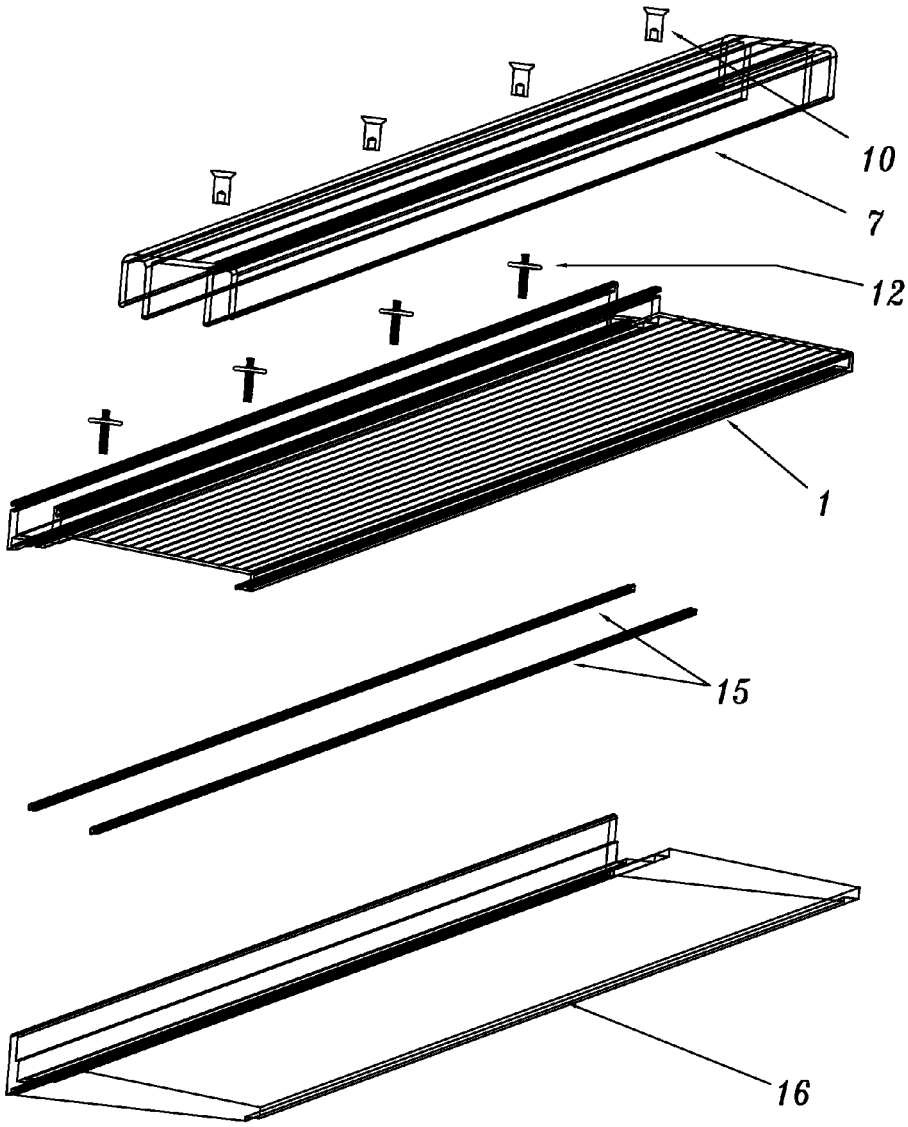
FIG. 3 is an exploded perspective view of the pre-assembled sill, showing all the components.
Figures 4, 5:
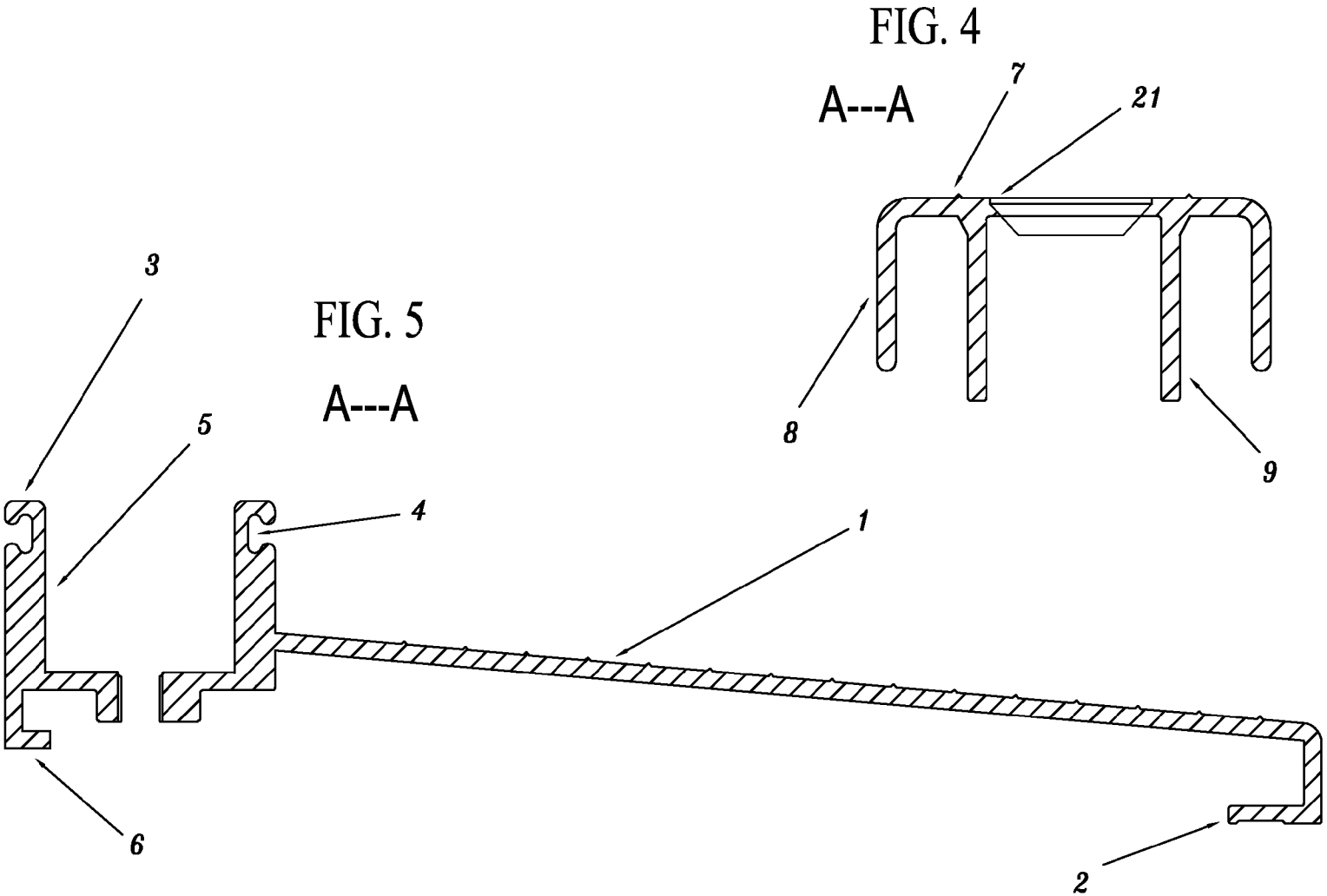
FIG. 4 is a cross-sectional side elevation view of the adjustable threshold cap, taken at the cross-section line A-A of FIG. 1.
FIG. 5 is a cross-sectional side elevation view of the sill housing, taken at the cross-section line A-A of FIG. 1.
Figure 8:
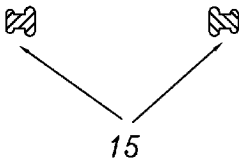
FIG. 8. is a cross-sectional side elevation view of the rubber gaskets, taken at the cross-section line A-A of FIG. 1.

With reference to FIG. 3, the sill assembly has a housing 1, which is a unitary body for holding together all the key components of the sill, and for providing a structure to be installed onto entry-way. The housing 1 is made of extruded aluminum using a die. With reference to FIG. 2, the housing 1 has a sloped top surface, for draining water away from the adjustable threshold cap 7, which is positioned directly under an entry-door. The housing 1 also has raised longitudinal ridges in equal distances, to prevent slippery to someone walking over it. The tallest part of the housing 1, where the adjustable threshold cap 7 is located, is placed longitudinally under an entry-door. The lowest part of the housing 1 is positioned longitudinally away from the entry-door, so that any rain-water will slide down the housing's sloped top surface to a street. As shown in FIG. 5, the housing 1 has a front foot 2, and two relatively thick vertical supporting walls 3. Both vertical supporting walls 3 are parallel to each other, and have equal height. Each wall 3 has a recessed channel 4 near the top, with the said recess-channel facing away from the U-shape channel 5. The two recessed channels 4 are facing opposite directions. They have identical dimensions and shape, each with a narrow opening and a wider interior. As shown by FIG. 2., the two recessed channels 4 accommodate the two gaskets 15. Both gaskets are made of extruded soft rubber; therefore, they are flexible and compressible. They provide air-tight and water-proof functions, when they are compressed by the interior side of the cap's outer walls 8. As indicated by FIG. 8, the two gaskets have same dimensions and shape. They have two enlarged sides and one narrow neck. As shown in FIG. 2, one gasket 15 is inserted into each recessed channel 4. The gaskets' narrow neck is being sandwiched by the recessed channel's opening, to prevent the gaskets from slipping out. The gaskets 15 are placed longitudinally in opposite directions, just like the two recessed channels 4, The gaskets' other enlarged side is protruding outside the recessed channels 4, and will be compressed by the interior of the adjustable threshold cap's outer walls 8, when the adjustable threshold cap 7 is being placed on top of the housing's walls.

Figure 1:
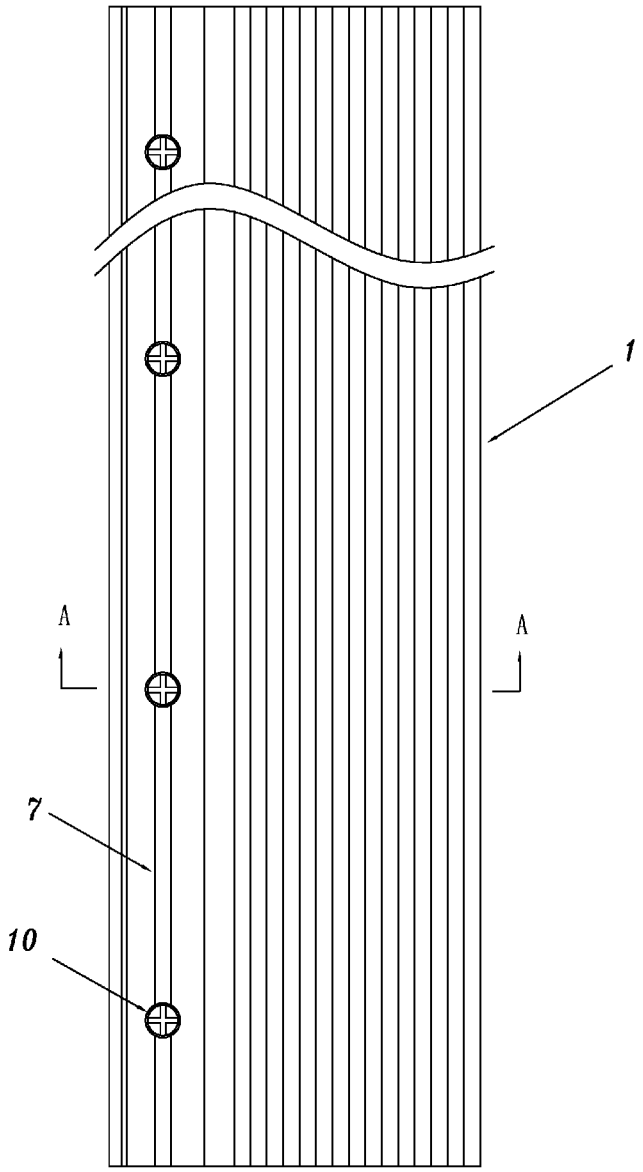
FIG. 1 is a top view of the completely-assembled sill with an adjustable threshold cap.
Figure 6:
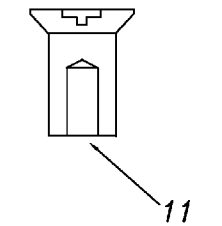
FIG. 6. is a cross-sectional side elevation view of the Phillips flat-headed cap-screw with a center hole at the bottom, taken at the cross-section line A-A of FIG. 1.
Figure 7:
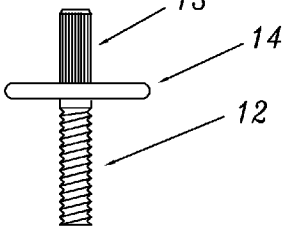
FIG. 7. is a side view of the adjustment screw showing the vertical straight threads at the head, a large diametric disc in the middle, and the male screw-threads in the lower portion.

The adjustable threshold cap 7, is made of extruded aluminum using a die. It covers the top portion of the housing 1. With reference to FIG. 4, the cap has two outer walls 8 and two inner walls 9. It is symmetrical along a vertical line at the center. When the cap is inserted onto the housing, the interior of the cap's outer walls 8 will be pressed against the gaskets 15 in their respective positions. As indicated in FIG. 2, the cap's inner walls 9 will stand onto the large diametric disc 14 of the adjustment screws 12, for support. As shown in FIG. 1, the threshold cap 7 has multiple screw-holes punched in equal spacings longitudinally, at the center of the threshold cap 7. All screw-holes have countersinks 21 (FIG. 4) to fit the cap-screws 10. The Phillips flat-headed cap-screws 10 (FIG. 6) have a center-hole 11 drilled from the bottom to the middle of the cap-screws. The cap-screws 10 are inserted through the cap's screw-holes with the Phillips head facing up, and the center-hole facing down. The cap-screws 10 are then coupled tightly to the adjustment screws 12 underneath, by mating the center-hole 11 with the head 13 of the adjustment screws 12. As shown in FIG. 7., the head 13 of the adjustment screws 12 has vertical straight threads; these vertical straight threads help tightening into cap-screws' center-hole 11, to prevent slippage and disengagement. Also referring to FIG. 7., the adjustment screws 12 have a large diametric disc 14 in the middle, and male screw-threads in the lower portion. The adjustment screws' large diametric disc 14 is made wide enough to shoulder the cap's two inner walls 9. Using both the cap-screws 10 and the adjustment screws 12 allows adjustment from the cap's top, and at the same time enables the support from the bottom adjustment screws 12. Because the cap-screws 10 are connected tightly with the adjustment screws 12, any rotational movement of the cap-screws 10 will automatically cause corresponding movement—in the same direction—of the adjustment screws 12 underneath.

As shown in FIG. 5, the housing 1 has a U-shaped channel 5, along housing's longitudinal axis. The U-shaped channel 5 is formed when the aluminum housing is extruded using a die. The purpose of having a U-shaped channel 5 is to accommodate the cap's inner walls 9, and to house the adjustment screws 12 which have a large diametric disc 14 in the middle. U-shaped channel's bottom has screw-holes tapped at the center, with equal spacings along the housing's longitudinal axis, in vertical alignment with the screw-holes on the cap 7. These screw-holes are tapped with female threads, so that the female threads are then mated with the adjustment screws' male threads.

Figure 9:
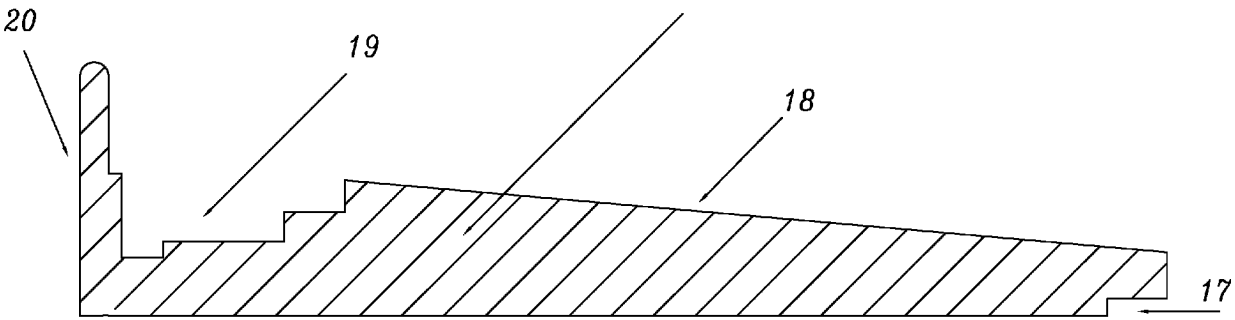
FIG. 9. is a cross-sectional side elevation view of the substrate, taken at the cross-section line A-A of FIG. 1.

As indicated by FIG. 9, the substrate 16 can be made of extruded vinyl, PVC, or composite materials, using a die. A portion of the substrate 16 also has a sloped top surface 18, just like the housing 1 does, so that the substrate can touch the housing's interior cavity to give better support to the housing. The substrate's front has a consistent indentation at the bottom 17 along the substrate's longitudinal axis. Such an indentation is formed when the substrate is extruded. The substrate's indented front 17 is to be fitted into the interior walls of the housing's front foot 2. Furthermore, the substrate 16 has three steps 19 as indicated in FIG. 9., to allow the housing 1 to sit on the substrate. The housing's back-foot 6 (FIG. 5) stands on top of the substrate's lowest step 19. As shown in FIG. 2, the substrate 16 has screw-holes which are also tapped perpendicularly with female threads, in equal spacing along the substrate's longitudinal axis, in alignment with the screw-holes in the cap 7, and also in alignment with the screw-holes in the housing's U-shaped channel 5. The substrate has a rising back-wall 20 with a round top. The back-wall 20 is to snug the housing 1 into its proper position, by pushing the housing 1 away, so that the back-wall 20 and the recessed steps 19 of the substrate further secure the housing in place. Moreover, the substrate's back-wall 20 is an intermediary part between the adjustable threshold cap 7 and the home's floor. The back-wall 20 (which is made of extruded vinyl) serves as an insulation so that outside heat or cold temperature passing through the sill is reduced.

During the final assembly, the cap-screws 10 are inserted through the cap's screw-holes, then are mated with the adjustment screws 12 underneath by coupling tightly the cap-screws' center hole 11 onto the head 13 of the adjustment screws 12, so that the cap 7 is fastened on the top by cap-screws, and is simultaneously supported below by adjustment screws' large diametric disc 14. The cap will be fitted onto the housing later, pending assembly of other components. Next, the rubber gaskets 15 are inserted into the recessed channels 4 of the vertical supporting walls 3 of the housing 1. Then, the substrate 16 is tucked under the housing 1, with the housing's back-foot 6 standing on the lowest recessed step 19 of the substrate. Because the substrate is hidden under the housing, the substrate is less susceptible to weatherization and possible damages. Finally, the cap is put onto the housing, with the interior of the cap's outer walls 8, compressing the rubber gaskets 15. The adjustment screws 12 are aligned with the screw-holes which have already been tapped on the housing's U-shaped channel 5 and the substrate 16. It is important to note that, by this time, all screw-holes in the cap 7, in the housing's U-shaped channel 5, and in the substrate 16 have been tapped with female screw-threads, all in alignment, with equal spacing along the housing's longitudinal axis, as described above. Using a Phillips-headed screw-driver, the cap-screws 10 are turned individually in the clockwise direction with one-turn, one screw following another. Turning the cap-screws 10 in the clockwise direction is repeated in the same manner and in the same sequence until the cap 7 sits uniformly on the top of the housing's two vertical supporting walls 3.

This sill assembly can be installed onto an entry-door unit, by fastening screws through the door jambs into the substrate's two lateral sides. Adjustment to the sill works like this: a person uses a Phillips-headed screw-driver to turn all cap-screws, one by one sequentially, in the same direction with the same number of turns each time. To raise the cap, a person turns cap-screws, one by one sequentially, in the counter-clockwise direction, with the same number of turns on each cap-screw. The fact that all cap-screws are turned one-by-one sequentially, in the same counter-clockwise direction, with the same number of turns, will ensure the cap is leveled with the housing. To lower the cap, a person uses a Phillips-headed screw-driver to turn all cap-screws, one by one sequentially, in the clockwise direction, with the same number of turns on each cap screw. The fact that the cap can be raised or lowered makes this sill assembly manually adjustable.

What I claim is:

1. A sill assembly with an adjustable threshold to be installed onto a floor under an entry-door; the said sill threshold to be flush with a bottom of the entry-door comprising:

(a) a housing with a front-foot, a back-foot, and two vertical supporting walls which form a U-shaped channel and accommodates two inner walls of a removable cap such that said cap inner walls are in direct contact with the vertical supporting walls, and wherein the housing includes a sloping top surface and the U-shaped channel houses adjustment screws;

(b) a substrate that has a flat bottom surface and is tucked under said housing to support said housing;

(c) the removable cap includes two outer walls and the two inner walls, configured to be inserted onto the housing; said cap is punched, in equal spacing, along a longitudinal axis of the removable cap, to form multiple screw-holes with countersinks;

(d) multiple flat-headed cap-screws are mounted flush with the cap and inserted through the cap screw-holes to mate with the adjustment screws;

(e) the U-shaped channel of the housing has multiple screw-holes which are tapped with female threads;

(f) the substrate has multiple screw-holes which are tapped with female threads;

(g) the adjustment screws include vertical straight threads at an upper portion thereof to mate with said cap-screws; each of said adjustment screws has a disc in a middle portion thereof to support the cap inner walls; said adjustment screws are fastened to the housing by fastening into the screw-holes of the U-shaped channel and the screw-holes of the substrate; and (h) two rubber gaskets are positioned in recessed channels located in the housing vertical supporting walls; each rubber gasket has two enlarged sides and a narrow neck which is secured with the recessed channel, so that the rubber gasket will not slip out.

2. A sill assembly of claim 1 wherein said recessed channels have the same dimensions; said recessed channels are positioned in opposite directions; the said recessed channels have a narrow opening and a large interior, which are used to fit and secure the rubber gaskets.

3. A sill assembly of claim 1 wherein the substrate has:

a.) an indented front to be inserted into the housing front foot, b.) a sloping top surface having the same slope as the sloping top surface of the housing, c.) recessed steps to receive the housing back-foot, with one step being tapped at multiple locations, perpendicular to the substrate's flat bottom surface, with female screw-threads to mate with the adjustment screws, d.) a back-wall, which together with the adjustment screws, is used to secure and fasten said housing onto said substrate.

4. A sill assembly of claim 1 wherein said gaskets are covered and protected by the cap to minimize deterioration due to weatherization and possible damages; said gaskets, being covered by the cap, create a uniform aesthetic appearance for the sill assembly.

5. A sill assembly of claim 1 wherein each disc of each adjustment screw supports the cap inner walls so that any weight being exerted onto the cap, is distributed to the adjustment screws which then disperse the weight onto the housing and the substrate below said cap.

6. A sill assembly of claim 1, wherein the outer walls of the removable cap compress against the two rubber gaskets to create a tight seal to prevent water, moisture, and air from penetrating said seal and the removable cap inner walls engage the disc of each adjustment screw.

* * * * *